United States Patent [19]
Parkinson et al.
[11] 4,275,511
[45] Jun. 30, 1981

[54] EVAPORATOR/SUBLIMATOR FLASK APPARATUS

[75] Inventors: Martin Parkinson, Nyack, N.Y.; Michael V. Dimitroff, Demarest, N.J.

[73] Assignee: Bio-Vac Incorporated, Nyack, N.Y.

[21] Appl. No.: 107,268

[22] Filed: Dec. 26, 1979

[51] Int. Cl.[3] ..... F26B 13/30
[52] U.S. Cl. ..... 34/92; 34/5
[58] Field of Search ..... 34/5, 92

[56] References Cited

U.S. PATENT DOCUMENTS

| | | | |
|---|---|---|---|
| 2,477,044 | 7/1949 | Carmean | 34/92 |
| 2,742,709 | 4/1956 | Woody et al. | 34/92 |
| 3,238,634 | 3/1966 | Voigtlaender-Tetzner | 34/92 |
| 3,246,674 | 4/1966 | Kapeker | 34/5 |
| 3,293,773 | 12/1966 | Frazer et al. | 34/92 |
| 4,024,648 | 5/1977 | Bender | 34/92 |

*Primary Examiner*—John J. Camby
*Attorney, Agent, or Firm*—Spellman, Joel & Pelton

[57] ABSTRACT

A vacuum evaporator/sublimator flask apparatus comprises an elastomer cap and a cylindrical glass body. The glass body is a straight-sided cylinder, preferably made of borosilicate glass tubing of sufficient wall thickness to prevent implosion when subject to high vacuum, open at one end and sealed at the other. The elastomer cap is preferably fabricated of clear elastomer in a one-piece molded arrangement which includes an upper neck portion, an outwardly extending sloping intermediate portion terminating in outer downwardly extending walls having an inwardly extending flange at the end thereof to engage the glass body. The neck portion has a tubular opening and a molded-in-place insert at the base of the neck to serve as a stop for rigid tubing that is inserted to permit connection to a vacuum system. The upper portion of the neck includes an inwardly extending portion which engages a vacuum insert. One or more vertical openings are molded into the rubber insert at the base of the stop and extend along the outwardly extending sloping portion of the cap and downwardly along an inner wall portion which is spaced from the downwardly extending outer wall of the cap. The said inner wall is spaced from a further concentric inner wall providing a recess therebetween to engage the upper portion of the cylindrical glass body. In operation, the neck collapses about the vacuum tube to form a seal therebetween and the outer wall portion collapses about the wall of the flask to form a seal thereabout.

10 Claims, 4 Drawing Figures

EVAPORATOR/SUBLIMATOR FLASK APPARATUS

BACKGROUND OF THE INVENTION

1. Field of the Invention

Vacuum distillation is historically the preferred method for concentrating or drying materials that may decompose at normal boiling temperatures. Obviously at lower than atmospheric pressures less kinetic energy and, therefore, lower boiling temperatures may be employed.

Evaporation procedures were greatly improved by the technique called "rotary evaporation." In this method, a solvent flask is rotated usually in a heated water bath, while the flask is under vacuum. The resulting thin film continually being developed as the flask rotates leads to rapid, low temperature evaporation with little or no "bumping" or necessity for a capillary leak or boiling stones.

Sublimation (also called lyophilization or freeze drying) is a process in which heat sensitive materials, such as proteins, hormones, antibiotics, vaccines and the like, may be safely dried for long term storage. Upon addition of water the freeze dried product reconstitutes to virtually the originally material. Viability of yeasts, molds, bacteria and viruses are often preserved by this process.

In sublimation, these effects are accomplished by first freezing the product solidly and then subjecting it to a high vacuum and controlled product heating. Under these conditions, the water goes directly from the solid ice state to water vapor—bypassing the liquid phase. The result of this gentle drying method is a dry product maintaining all or most of its original desirable characteristics. The dry product is usually stored under vacuum or inert gas, such as nitrogen. Usually no further refrigeration is required and the product may be stored for months or years at room temperature.

2. Description of the Prior Art

Vacuum flasks suitable for use in rotary evaporation or sublimation (freeze drying) are, for all practical purposes, identical to each other in their preferred sizes, shapes and materials of fabrication. Methods devised over the years at improving their everyday utility are, again, too similar to distinguish one from another. However, flasks for sublimation (freeze drying) are routinely subjected to much higher vacuums than rotary evaporator flasks and, therefore, both fabrication and suggested improvements must be at least to the standards of rotary evaporator flasks and, in fact, usually to much higher standards. For reasons of simplicity, therefore, the following discussion of the prior art will be limited to sublimation (freeze drying) flasks.

Orginally, freeze drying was accomplished by placing the material to be dried in a glass flask, then rotating the flask slowly in a dry ice and acetone (or other suitable solvent) bath until the contents were solidly frozen and finally connecting this flask, via rubber tubing or a rubber vacuum valve, to a steel manifold which had been previously evacuated to a high vacuum. The manifold in turn was connected in series between a dry ice and solvent refrigerated water vapor condenser and a high vacuum pump.

This manifold freeze drying method is still in wide use today except that mechanical (fluorocarbon) refrigeration for the water vapor condenser has largely replaced the use of day ice. The reasons for manifold freeze drying's continued use is the extreme simplicity of the method, particularly for biomedical research applications. The method does not require special training for successful use; samples are clearly observed during drying; the heat required for efficient sublimation is conveniently applied by ambient room temperature and moisture condensing on the flask surface; the end point, when the product is dry, can often be determined by simply touching the flask to check for cold spots not yet completely sublimated; typically many flasks, even containing different materials, may be processed at one time; flasks can be introduced and withdrawn during operation without disturbing other flasks; certain types of flasks can be easily disengaged to provide wide mouth access to the dried product.

Early attempts at freeze drying used pear-shaped glass containers with a standard taper ground glass neck which connected directly to a manifold. They worked fairly well, but the flask was fabricated in two pieces, each with a ground glass flange which could be secured together with silicone or other suitable vacuum grease for high vacuum operation. At the conclusion of a dehydration, the top and bottom sections were disengaged to provide wide mouth access to the dried product.

These classic flasks are still in use today since they provide the researcher with highly desirable total visability and rapid spark induction coil (Tesla coil) vacuum leak detection. However, two disadvantages limit their use. The major problem by far is the necessity for using vacuum grease. It is extremely difficult to prevent vacuum grease contamination of the product, which fact alone greatly limits their use for many applications, and vacuum grease itself is disagreeable to work with since it is difficult for technicians to remove it from their hands, clothing and virtually anything else it contacts.

The second problem with these flasks is that during freezing in a typical dry ice solvent bath, the flask must be manually or mechanically rotated in such a way as to prevent the material within the flask from contacting the flange juncture of the top and bottom and also to keep this greased junction itself away from harmful solvent action that could prevent a high vacuum seal from obtaining later. The resultant frozen plug is far from ideal for efficient heat transfer and sublimation rates, invariably leading to substantially longer drying times than would apply if it were permissible to freeze the sample in a horizontal position to achieve a layer of ice of uniform depth and maximum surface area for sublimation to occur.

In recent years numerous attempts have been made to overcome these difficulties, particularly with reference to eliminating vacuum grease. Silicone rubber gaskets and O-rings have been employed between rigid tops and bottoms, sometimes necessitating metal spring closures to prevent them from falling apart in handling, and invariably requiring the junction to be raised above the cold bath during freezing. And even if a clear elastomer was used, the spark induction coil (Tesla coil) leak detection would be difficult or impossible.

Rigid or semi-rigid caps have been used, presumably to avoid both the use of vacuum grease and to permit freezing the flask in a horizontal position. No clear explanation is given in the case of a totally rigid flask as to why the glass portion doesn't break when ice expands upon freezing. And in the case of a resilient cap, no explanation is given as to the reliability of such a seal upon ice expansion or how the heat transfer solvent is positively prevented from gaining access to the interior of the flask itself freezing, which would harm or destroy the product. In both cases, no provisions are made for Tesla coil leak inspection and their designs rule out modifications to make this possible.

SUMMARY OF THE INVENTION

The present invention provides a simple, two component evaporator/sublimator flask with inherent substantial economies in fabrication. The base is a straight sided cylinder, preferably made of borosilicate glass tubing of sufficient wall thickness to prevent implosion when subjected to a high vacuum, open at one end and sealed at the other. A relatively flat bottom is usually preferred for ease in use. The open end of the flask requires no special glass working other than simple fire polishing to eliminate sharp cutting edges since this edge does not enter into the vacuum seal as is the case with other flasks.

The elastomer cap is preferably fabricated in clear silicone rubber or other suitable clear elastomer, such as polyurethane rubber. Durometer of the cap is preferably between 30 and 50 shore A scale.

These two components yield an evaporator/sublimator flask with all of the following desirable characteristics:

1. Large access for sample removal
2. Glassware extremely easy to clean
3. Unbreakable elastomer top
4. Greater safety in handling against breakage of glass bottom
5. Extremely secure seal between flask top and bottom, clearly and easily observed
6. Virtually no danger of flask top and bottom coming apart in routine handling—yet the elastomer top is easily connected or removed from the glass base
7. Positive liquid seal around the circumference of the flask whether under vacuum or at atmospheric pressure
8. Unusually reliable vacuum tight seal between the flask, top and adapter
9. Using a clear elastomer top, if a vacuum leak should occur it is easily seen and corrected
10. Filters (bacterial, etc.) may be placed at the base of the neck of the cap without danger of vacuum leaks
11. Various liners, such as teflon, polypropylene and buna N may be used with the top for virtually all solvent evaporations
12. Holes may be made in the elastomer top for insertion of a thermometer or other temperature sensing device.
13. The flask operates with equal efficiency in a horizontal or 45° angle position.
14. The flat base greatly facilitates filling, product removal and flask storage.
15. The configuration of the flask makes it especially well suited to convenient horizontal operation for rotary evaporation procedures.
16. At the conclusion of an evaporation or sublimation, the neck of the cap may be partially pulled away from the rigid tubing connecting the flask assembly to the vacuum system and a suitable clamping device will then permit removing the flask assembly from the vacuum system with the flask still under the original vacuum. In this fashion this flask assembly can be used as a long term vacuum storage container.

Accordingly an object of this invention is to provide a new and improved flask apparatus for vacuum applications.

Another object of this invention is to provide a new and improved evaporator/sublimator flask apparatus particularly suited for freeze drying.

BRIEF DESCRIPTION OF THE DRAWINGS

Other objects and advantages of the present invention may be seen from the following description when viewed in conjunction with the accompanying drawings wherein.

DETAILED DESCRIPTION OF THE INVENTION

Figure 1:
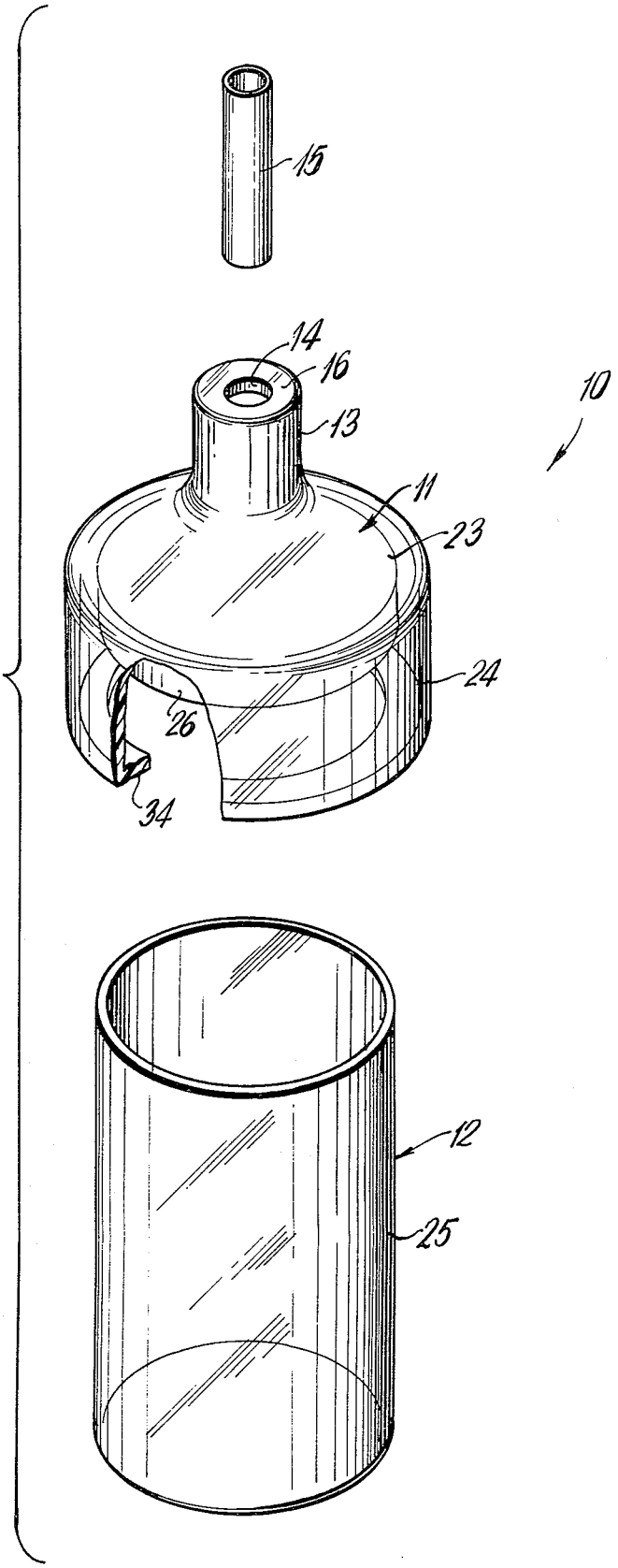
FIG. 1 is a perspective view of the flask apparatus comprising the invention.
Figure 2:
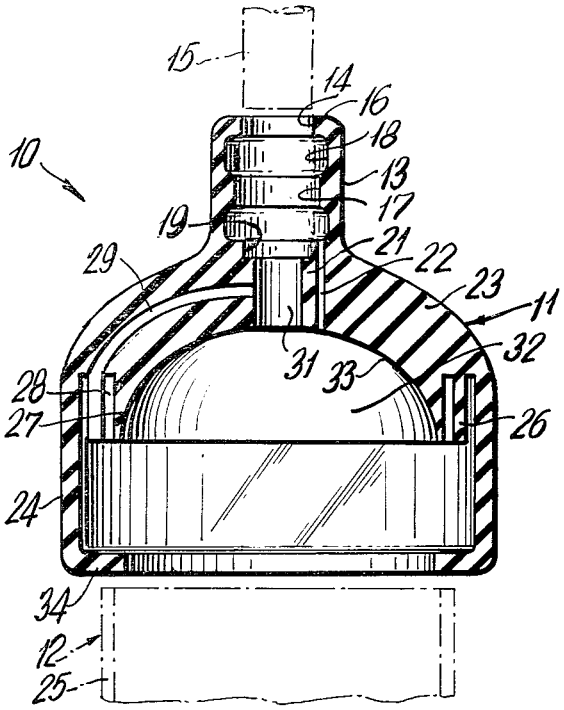
FIG. 2 is a cross-sectional view taken along line 2—2 of FIG. 1 showing the elastomer cap at atmospheric pressure prior to placement over the flask.

Referring now to the drawings, the vacuum evaporator/sublimator flask 10 comprises a cap 11 for connection to a vacuum apparatus (not shown) and a flask 12 which contains product undergoing an operation such as freeze drying. The cap 11 is molded in one piece from a clear elastomer such as clear silicone or clear polyurethane rubber. The flask 12 comprises a substantially cylindrical glass body over which the cap 11 is mounted.

The cap 11 comprises an upper neck portion 13 having a cylindrical outer configuration with a central aperture 14 normally ranging from ½" I.D. to ¾" I.D. for insertion of a vacuum connector tube 15. The upper surface 16 of the neck 13 extends inwardly to engage the tube 15 together with a molded protruding ring 17 positioned at approximately the mid-point of the inner surface 18 of the neck 13 and a lower portion 19. A molded-in-place elastomer insert 21 serves as a stop for the rigid tubing 15. One or more vertical openings 22 are molded into the insert 21 to provide a vacuum path collapsing the neck 13 about the tube 15 therewith to form a seal.

The cap 11 also includes a sloping shoulder portion 23 of relatively substantial thickness leading to outer downwardly extending walls 24 normally spaced from the walls 25 of the flask 12. The cap 11 further includes concentric downwardly extending walls 26 and 27 spaced from the outer wall 25 and with a recess 28 between said walls 26 and 27 to engage the upper portion of the flask 12. The intermediate wall includes at least one aperture 29 extending upwardly and along the shoulder to the cavity 31 which leads to the larger cavity 32 between the inner curved surface 33 of the cap 11 and the flask opening. The aperture 29 provides a vacuum path to collapse the walls 24 of the cap 11 about the flask walls 25 in a tight seal.

Figure 4:
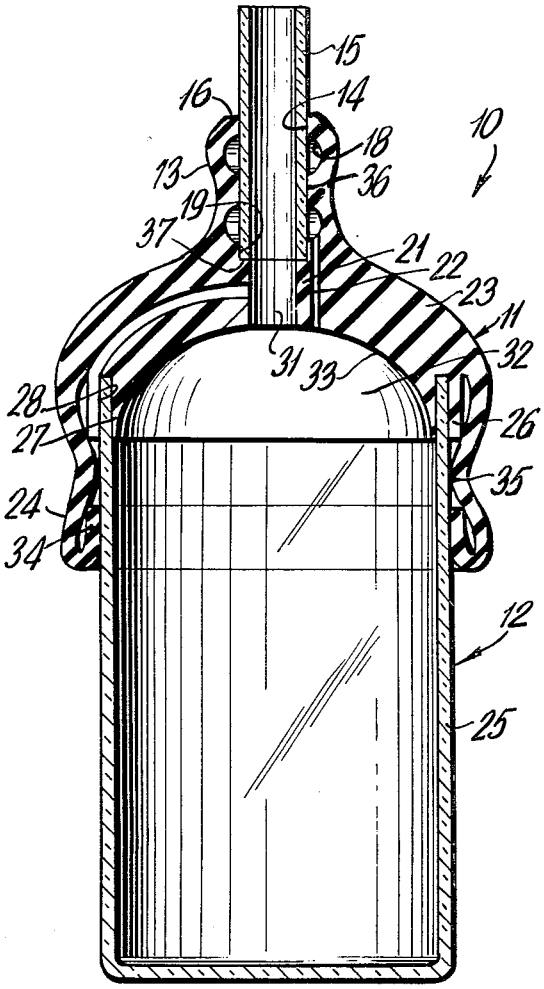
FIG. 4 is a view similar to FIG. 3 showing the apparatus under a vacuum wherein the cap is sealed about the glass flask.
Figure 3:
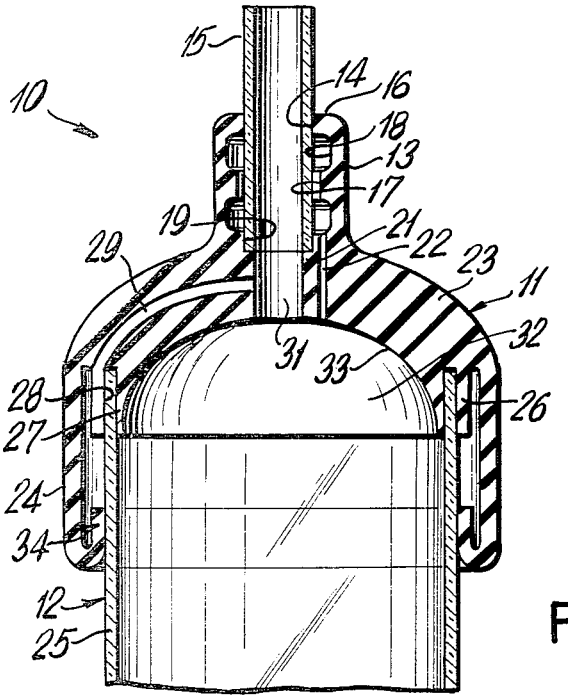
FIG. 3 is a cross-sectional view showing the cap positioned on the flask.

The outer walls 24 of the cap 11 include end portions 34 which normally extend inwardly at a right angle thereto but are bent upwardly as in FIG. 3 when the flask 12 is inserted at atmospheric pressure. FIG. 4 shows the seal which is formed under vacuum at point 35 between the cap wall 24 and the flask wall 25 and along the wall at the top of the neck 13. The top portion of the larger section of the cap 11 must be of sufficient durometer and thickness to withstand the atmospheric pressure that obtains when a vacuum is applied without collapsing or notably distorting. This invention provides for this while utilizing much less material of a much lower durometer.

In a typical operation, liquid material to be evaporated or sublimated is placed in the rigid base 12 and the cap 11 is secured. For sublimation, material is then frozen either upright or at any angle up to a horizontal position. While freezing is in a horizontal position, it is of vital importance that a completely reliable liquid seal is maintained between the outer wall 25 of the base 12 and the cap 11 to prevent heat transfer solvents from contaminating the product. This is provided by the end portions 34 of the cap 11 as illustrated in FIG. 3.

Equally important when freezing in a horizontal position is to accommodate for the expansion of ice which occurs during freezing. In this invention the low durometer cap 11 easily accommodates to this expansion without danger of cracking the rigid base 12. Since it is not necessary for the top surface of the flask 12 to yield a high vacuum tight seal, the top of the flask 12 may become completely disengaged from the inner surface on the cap 11 due to the ice expansion without any effect whatsoever on the high vacuum seal that subsequently must be obtained.

Once the sample is ready to be processed, the flask 10 is connected directly to the rotary evaporator or freeze dryer via a suitable glass, metal or plastic tube 15. In the invention, filter paper may be placed within the neck 13 of the cap, if required, prior to the insertion of the vacuum connecting tube 15 without interfering with subsequent high vacuum performance.

With the cap 11, flask 12 and vacuum connector tube 15 secured, the source of vacuum to the rotary evaporator or freeze dryer is turned on. Most of the elongated portion of the neck 13 and the outer skirt 24 of the cap 11 collapses due to atmospheric pressure. The neck 13 forms a high vacuum tight seal with the vacuum tubing connector 15 while the outer skirt 24 on the cap 11 provides a high vacuum tight seal with the flask 12. The molded-in-place vertical opening 22 in the rubber insert within the cap neck 13 connects this neck section directly to the vacuum system for continuous evacuation and aperture 29 extending upwardly and along the shoulder to the cavity 31 provides for continuous evacuation of the area between the outer wall of the flask 12 and the inner wall of the downwardly extending walls 24 of the cap 11.

Thus it can be seen that rather than typically relying on compressing rubber against a top edge of a flask to obtain a high vacuum tight seal, or to rely on the base edge of a vacuum tubing connector against a rubber cap, the vacuum sealing occurs along the length of the collapsed neck 13 and the length of the collapsed skirt 24. This unique sealing method provides a vastly increased sealing area over traditional methods so that irregularities and even defects in the rigid base or vacuum tube assembly are easily compensated for. Thus glass and other material fabrication can be accomplished much more economically than if strict dimensional tolerances must be maintained as is the case with traditional evaporator/sublimator flask apparatus.

The top edge of the flask 12 is completely free of any role in vacuum sealing so that inert liners may be placed over it or it may be severely displaced by ice expansion if the material is frozen in a horizontal position. The bottom edge of the vacuum tubing 37 connector is also free of any role in vacuum sealing so its function may instead be to secure filter paper or a bacterial filter if required. The vacuum tubing connector 15 may also be partially removed from the neck 13 of the cap 11 so that a suitable clamp may be placed on the neck 13 to preserve the original vacuum, thus converting this flask assembly 10 into a convenient longterm vacuum storage chamber.

In traditional evaporator/sublimator flask assemblies, the cap must be of rigid glass or plastic or extremely heavy wall, high durometer rubber. In this invention, a large percentage of this force is removed by having the neck wall 13 collapse upon the vacuum tubing connector 15, thus greatly reducing the atmospheric pressure on the overall surface of the cap 11. The configuration of the neck 13 must be precise so that the vacuum tube connector is securely grasped by the collapsing wall of the neck 13 in time to prevent it from carrying the rubber neck insert and the neck itself into the base portion of the flask 12. Since we now, in effect, have substantially less atmospheric pressure acting on the entire surface of the cap, we can now fabricate the cap 11 from considerably less material and of substantially less durometer.

Finally, and most importantly in sublimation procedures, by having the neck 13 and outer skirt 24 of the cap 11 collapse to form the high vacuum tight seal, it now becomes possible, conveniently and rapidly, to locate sources of vacuum leaks that may occur in the freeze dry flask assembly. By making the cap 11 out of clear silicone rubber or clear polyurethane rubber and the rigid base 12 from borosilicate glass or clear, rigid plastic, it is now practical to use a spark induction coil (Tesla coil) for rapid leak detection, since air leakage can now only occur at the top portion of the neck 13 or at the radial indent at the bottom of the cap skirt closure, thereby approximating the conditions under which it was possible to use a Tesla coil in past freeze dry flask assemblies that had to rely on vacuum grease for a seal. This is an important convenience in manifold freeze drying. Typically several containers, or even a dozen or more are being processed on the manifold freeze drying apparatus at one time. Should the vacuum gauge indicate a leak has developed, it is necessary to isolate quickly the source of the difficulty. A prolonged search can result in harm or destruction of valuable samples. Using a spark induction coil, the many sources of vacuum leaks inherent in connecting many freeze drying flasks to a freeze dryer can be checked in a matter of minutes, either locating the source of the leak for rapid correction, or eliminating the flasks as the source of the trouble.

Another advantage in using clear silicone rubber or clear polyurethane rubber for sublimation is that more uniform product drying will occur if the freeze dry flask apparatus is frozen in a horizontal position. Containers using opaque plastic or rubber prevent some radiant heat from entering that portion of the sample shaded by the opaque cap thereby delaying complete drying of that portion of the sample.

It is understood that the above-described arrangements are merely illustrative examples of the application. Numerous other arrangements may be readily devised by those skilled in the art which will embody the principles of the invention and fall within the spirit and scope thereof.

We claim:

1. An evaporator/sublimator flask apparatus for connection to a vacuum connector tube comprising:

a substantially cylindrical body having a base at one end and being open at the other end, and, a cap of an elastomeric material mounted over the body comprising an upper neck portion having an aperture therethrough for insertion of a vacuum connector tube, an intermediate outwardly sloping shoulder portion and downwardly extending outer walls having an inwardly extending flange at the bottom surface thereof, whereby said cap engages said bottom surface, and a first vacuum path within the cap leading from the cylindrical body to the neck portion whereby the neck collapses about said vacuum connector tube when a vacuum is applied through the tube and a second vacuum path within the cap from the cylindrical body to the interior of the outer wall so that the outer walls collapse about the body forming tight seals when a vacuum is applied to the apparatus through the tube.

2. An evaporator/sublimator flask apparatus in accordance with claim 1 wherein:

the cap has an inner guide portion comprising spaced concentric wall portions extending downwardly from the shoulder with a recess therebetween to engage the upper portion of the body.

3. An evaporator/sublimator flask apparatus in accordance with claim 1 wherein:

the guide portion includes at least one aperture extending upwardly within the outer concentric wall to the neck portion to provide a vacuum path to collapse the downwardly extending outer walls about the body under vacuum.

4. An evaporator/sublimator flask apparatus in accordance with claim 3 wherein:

the cap further includes a molded-in-place stop at the base of the neck to engage the vacuum tube comprising a circular protrusion extending inwardly and having a central aperture therethrough to provide a vacuum to the glass body, and said cap further including a cylindrical wall extending upwardly from the stop for a predetermined distance to contact the walls of the vacuum tube, said cylindrical wall having an aperture therethrough to provide a vacuum path to collapse the neck about the tube.

5. An evaporator/sublimator flask apparatus in accordance with claim 1 wherein:

the cap comprises a one-piece clear molded elastomer.

6. An evaporator/sublimator flask apparatus in accordance with claim 4 wherein:

the neck includes a circumferential protrusion extending inwardly at about the mid-point thereof.

7. An evaporator/sublimator flask apparatus in accordance with claim 1 wherein:

when vacuum is applied, the top portion of the cap neck and the base portion of the downwardly extending outer wall of the cap form a vacuum seal with the vacuum connector tube and the base so that a spark induction coil may be used for rapid vacuum leak detection.

8. An evaporator/sublimator flask apparatus in accordance with claim 1 further including:

a filter mounted across the neck aperture within the flask apparatus.

9. An evaporator/sublimator flask apparatus in accordance with claim 1 further including:

an inert liner inserted in the inside of the outwardly sloping shoulder portion of the cap.

10. An evaporator/sublimator flask apparatus in accordance with claim 1 wherein:

the neck portion of the cap and the outwardly sloping shoulder portion and downwardly extending outer walls serve for general purpose connection of tubing of widely different diameters for vacuum applications.

* * * * *